US006503106B1

(12) United States Patent
Suzuki

(10) Patent No.: US 6,503,106 B1
(45) Date of Patent: Jan. 7, 2003

(54) ELECTRIC JACK

(75) Inventor: Yoshiaki Suzuki, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 09/969,842

(22) Filed: Oct. 3, 2001

(51) Int. Cl.[7] ..... H01R 24/04
(52) U.S. Cl. ..... 439/669; 669/939
(58) Field of Search ..... 439/669, 939, 439/668

(56) References Cited

U.S. PATENT DOCUMENTS 6,270,380 B1 * 8/2001 Shichida et al. ..... 439/669

FOREIGN PATENT DOCUMENTS

EP 871 077 A2 10/1998
GB 2139018 A 10/1984
JP 01 063283 3/1989
JP 2633258 4/1997

* cited by examiner

*Primary Examiner*—Gary Paumen
*Assistant Examiner*—Ann McCamey
(74) *Attorney, Agent, or Firm*—Darby & Darby

(57) ABSTRACT

A jack includes a housing having a cylindrical piece, a body, and at least one external connection terminal. The cylindrical piece includes a plug insertion hole and the body includes an inner chamber. The plug insertion hole and the chamber receive a plug for electrical connection to a circuit. The external connection terminals are fixed to the housing in grooves to simplify assembly. The external connection terminals include elastic pieces and contact pieces. During an assembly with the plug, elastic pieces elastically urge contact pieces into electrical contact with an inner conduction portion of the plug and provide secure electrical connection.

23 Claims, 7 Drawing Sheets

ELECTRIC JACK

BACKGROUND OF THE INVENTION

1. Field of the Invention

The present invention relates to an electric jack. More specifically, the present invention relates to an electric jack which has both internal connection terminals and external connection terminals for use in mobile phones or other equipment.

2. Description of the Related Art

Japanese Laid-Open Patent Publication Number 64-63283, discloses a jack including a housing and an internal contact. The housing includes a tubular piece. The internal contact has a contact piece placed in an interior of the housing. A cap-shaped external contact is located on the tubular piece. Audio signals are transmitted from a device body to a headphone (including an earphone) by the internal contact. The external contact transmits a control signal from a remote control to a device body.

The external contact has a tubular shape (cap-shaped). The external contact is held in place by joining an end portion of the housing. In use, the external contact is connected to the jack. Unfortunately, in this device, the jack is so small that a jack of useful size has room for only one external contact. Since the control signal transmitted is limited, the jack cannot be used for a multi-functional portable audio device.

OBJECTS AND SUMMARY OF THE INVENTION

An object of the present invention is to provide a multipolar connector which overcomes the limitations of the prior art.

It is another object of the present invention is to provide a multipolar connector equipped with a plurality of external contacts and an internal contact.

It is another object of the present invention to provide a multipolar jack connector that allows secure electrical connection between a plurality of external contacts and at least one internal contact.

It is another object of the present invention to provide a jack that may be easily adapted for use in a plurality of portable and fixed electronic devices.

It is another object of the present invention to provide a jack that may be easily adapted to multi-functional uses.

It is another object of the present invention to provide a jack that is easily adapted to multi-polar designs and is effective to minimize the overall size of the jack.

It is another object of the present invention to provide a jack that is easy to manufacture and provides stable and secure connection to a plug while eliminating instability during soldering to a substrate.

It is another object of the present invention to provide a jack that is readily adapted to handle a plurality of signals or remote controlled devices, such as headphones.

The present invention relates to a jack including a housing having a cylindrical piece, a body, and at least one external connection terminal. The cylindrical piece includes a plug insertion hole and the body includes an inner chamber. The plug insertion hole and the chamber receive an plug for electrical connection to a circuit. The external connection terminals are fixed to the housing in grooves to simplify assembly. The external connection terminals include elastic pieces and contact pieces. During assembly with a plug, elastic pieces elastically urge contact pieces into electrical contact with an inner conduction portion of the plug to provide secure electrical connection.

According to an embodiment of the present invention there is provided a jack for electrically connecting a plug to a circuit, the jack comprising: a housing, the housing including a body piece and an insertion piece, the insertion piece having a first perimeter and an insertion hole, the body piece bounding a chamber adjacent the insertion hole, the insertion hole and the chamber effective to receive the plug during a plug insertion along a plug insertion direction, at least a first external connection terminal in the housing, the first external connection terminal including at least a first contact piece, a first elastic piece, a first leg piece, and a first latching tab, the first elastic piece operable parallel to the plug insertion direction, the first leg piece extending perpendicular to the plug insertion direction, the first latching tab fixing the first external connection terminal in at least a first long groove in the housing, the first contact piece extending away from the insertion hole and being proximate the first perimeter prior to the plug insertion, and the first elastic piece and the first contact piece effective to elastically engage a first inner portion of the plug during the plug insertion and displace the first contact piece toward the insertion hole, whereby the jack enables reliable and elastic electrical connection from the plug to the circuit.

According to another embodiment of the present invention there is provided a jack, further comprising: at least a second external connection terminal in the housing, at least a second long groove in the housing, the first long groove being parallel to the plug insertion direction, and the second long groove being parallel to the plug insertion direction.

According to another embodiment of the present invention there is provided a jack, further comprising: a first holding piece on the first external connection terminal, a first support piece on the first external connection terminal, the first support piece including a first bent piece projecting perpendicular from the first support piece, and the first long groove effective to guidably receive the first holding piece, the first support piece, and the first latching tab and retain the first external connection terminal in the first long groove, thereby supporting the first elastic piece and the first contact piece.

According to another embodiment of the present invention there is provided a jack, wherein: the second external connection terminal includes at least a second contact piece, a second elastic piece, a second leg piece, and a second latching tab, the second leg piece extending perpendicular to the plug insertion direction, the second contact piece extending away from the insertion hole and being proximate the first perimeter prior to the plug insertion, and the second elastic piece and the second contact piece effective to elastically engage a second inner portion of the plug during the plug insertion and displace the second contact piece toward the insertion hole, whereby the jack enables reliable and elastic multi-pole electrical connection from the plug to the circuit.

According to another embodiment of the present invention there is provided a jack, further comprising: a second holding piece on the second external connection terminal, a second support piece on the second external connection terminal, and the second long groove effective to guidably receive at least the second holding piece, the second support piece, and the second latching tab and retain the second external connection terminal in the second long groove, thereby supporting the second elastic piece and the second contact piece.

According to another embodiment of the present invention there is provided a jack, further comprising: a first short groove, the first short groove continuous with at least the first long groove, a second short groove, the second short groove continuous with at least the second long groove, the first short groove effective to receive the first elastic piece and enable the first elastic piece and the first contact piece to elastically displace toward the insertion hole during the plug insertion, whereby the first elastic piece has sufficient room to elastically flex in the first short groove while minimizing a size of the jack, and the second short groove effective to receive the second elastic piece and enable the second elastic piece and the second contact piece to elastically displace toward the insertion hole during the plug insertion, whereby the second elastic piece has sufficient room to elastically flex in the second short groove while minimizing the size of the jack.

According to another embodiment of the present invention there is provided a jack, wherein: the first and the second leg pieces extend parallel to a substrate face of the jack, thereby enabling secure soldering of the jack to an external substrate and the circuit.

According to another embodiment of the present invention there is provided a jack, wherein: the first and the second leg pieces extend perpendicular to a substrate face of the jack, thereby enabling securing soldering of the jack to an external substrate and the circuit.

According to another embodiment of the present invention there is provided a jack, wherein: the body piece including a plurality of inner connection terminal holes, the plurality of inner connection terminal holes begin digitally accessible on a side of the body piece opposite the insertion piece, and the plurality of inner connection terminal holes effective to securely receive at least one corresponding inner connection terminal during an assembly of the jack, whereby the jack is easily and rapidly assembled and production time is reduced.

According to another embodiment of the present invention there is provided a jack, further comprising: a first end portion on the first elastic piece opposite the first leg piece, a second end portion in the second elastic piece opposite the second leg piece, a first wall in the first short groove opposite the first end portion, a second wall in the second short groove opposite the second end portion, the first end portion contacting the first wall during the insertion, the second end portion contacting the second wall during the insertion, and the first and the second walls effective to restrain an elastic deflection of the first and the second end portions in a deflection direction during the insertion, thereby enabling a secure and stable electrical connection with an increased elastic resistance.

According to another embodiment of the present invention there is provided a jack, further comprising: a first distance between the first contact piece and the first end portion, a second distance between the second contact piece and the second end portion, the first inner portion being opposite the first contact piece, the second inner portion being opposite the second contact piece, the first distance is not equivalent to the second distance, and the first contact piece and the second contact piece being effective to provide elastic electrical connection to corresponding the first and the second inner portions of the plug, whereby the jack is easily adapted to differing plug designs while providing secure electrical connection.

According to another embodiment of the present invention there is provided a jack, comprising: a housing, the housing including a body piece and an insertion piece, the insertion piece having a first perimeter and an insertion hole, the body piece bounding a chamber adjacent the insertion hole, the insertion hole and the chamber effective to receive the plug during a plug insertion along a plug insertion direction, first external connection means for elastically engaging a first inner portion of the plug during the plug insertion and electrically connecting to the circuit, the first external connection means including at least a first contact piece and a first elastic piece, means for fixing the first external connection means to the housing, the first elastic piece elastically engaging the first inner portion of the plug, the first contact piece extending away from the insertion hole and being proximate the first perimeter prior to the plug insertion, whereby the first external connection means and the means for fixing provide secure elastic electrical connection from the plug to the circuit.

According to another embodiment of the present invention there is provided a jack, comprising: an insulating housing, the insulating housing including a cylindrical piece and a body piece, the cylindrical piece including a plug insertion hole, the body piece including a hollow adjacent the plug insertion hole, the hollow and the plug insertion hole effective to receive the plug from a plug insertion direction during a plug insertion, at least a first internal terminal connecting to a first conductive piece of the plug during the plug insertion, at least a first external connection terminal, the first external connection terminal having at least a first contact piece, and the first contact piece proximate an outer perimeter of the cylindrical piece effective to elastically and securely connect a second conductive piece of the plug to the circuit during the plug insertion.

According to another embodiment of the present invention there is provided a jack, wherein: the first external connection terminal includes a first holding piece, the first holding piece being effective to retain the first external connection terminal in the housing, the first external connection terminal includes a first elastic piece, the first contact piece on the first elastic piece, and the first elastic piece extends in a direction parallel to a plug insertion direction and elastically deforms during a plug insertion to elastically and securely electrically connect the first contact piece to a first inner conducting piece of the plug.

According to another embodiment of the present invention there is provided a jack, wherein: the first external connection terminal includes a first end piece, the end piece on the first elastic piece opposite the first holding piece, the first end piece in a position opposite the cylindrical piece, the first end piece bent in a direction toward the plug insertion hole, and the first end piece effective to contact a surface of the cylindrical piece during the plug insertion, whereby the jack provides secure electrical connection from the plug to the circuit.

According to another embodiment of the present invention there is provided a jack, wherein: the first contact piece between the first end piece and the first holding piece on the first elastic piece, whereby a position of the first contact piece is easily adaptable by an external manufacturer to match the plug.

According to another embodiment of the present invention there is provided a jack, wherein: the first contact piece protruding from the first elastic piece in a first direction away from the insertion hole, whereby the first contact piece can easily electrically connect to an inner conductive surface of the plug.

According to another embodiment of the present invention there is provided a jack, wherein: the first holding piece includes a first support piece, the first support piece extending perpendicular from the first holding piece, a first long groove in the body piece, the first long groove parallel a lower surface of the body piece, and the first support piece retained in the first long groove, whereby elastic electrical connection with the plug is simplified.

According to another embodiment of the present invention there is provided a jack, further comprising: a first short groove in the body piece, the first short groove continuous with the first long grove, the first short groove effective to receive the first elastic piece during the plug insertion thereby enabling secure electrical connection from the plug to the circuit.

According to another embodiment of the present invention there is provided a jack, further comprising: a first leg piece on the first external connection terminal, and the first leg piece extending away from the external connection terminal perpendicular the insertion direction.

According to another embodiment of the present invention there is provided a jack, wherein: the first external connection terminal is effective as a first terminal for conducting an external control signal from the plug to the circuit.

According to another embodiment of the present invention there is provided a jack, wherein: the jack and the first external connection terminal is effective to control an external remote control.

The external connection terminal includes a holding piece, held by the housing, and an elastic piece, that extends in a direction parallel to a plug insertion direction and elastically deforms when connecting with a conductive piece of the plug.

By bending an end of the elastic piece inward, the end contacts the cylindrical piece when the elastic piece connects with the conductive piece.

The contact piece is in a symmetric position with respect to the plug insertion hole but is positioned at shifted positions with respect to the plug insertion direction. These positions and the design which allows the contact piece to protrude outward, minimize jack size.

On the body, a vertical groove extends from the horizontal groove. The holding piece is housed in the vertical groove. One end of the external connection terminal has a leg piece that is either surface-mounted or through-mounted onto a conductive piece of a substrate. The external connection terminal is a terminal for control signal. A remote control can be controlled through the external connection terminal.

The above, and other objects, features, and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
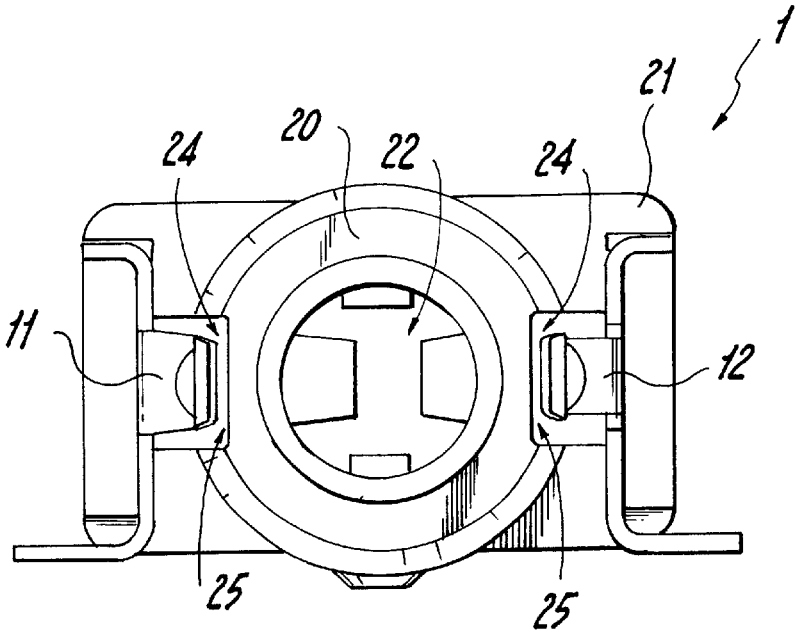
FIG. 1 is a front view of a jack according to an embodiment of the present invention.
Figure 2:
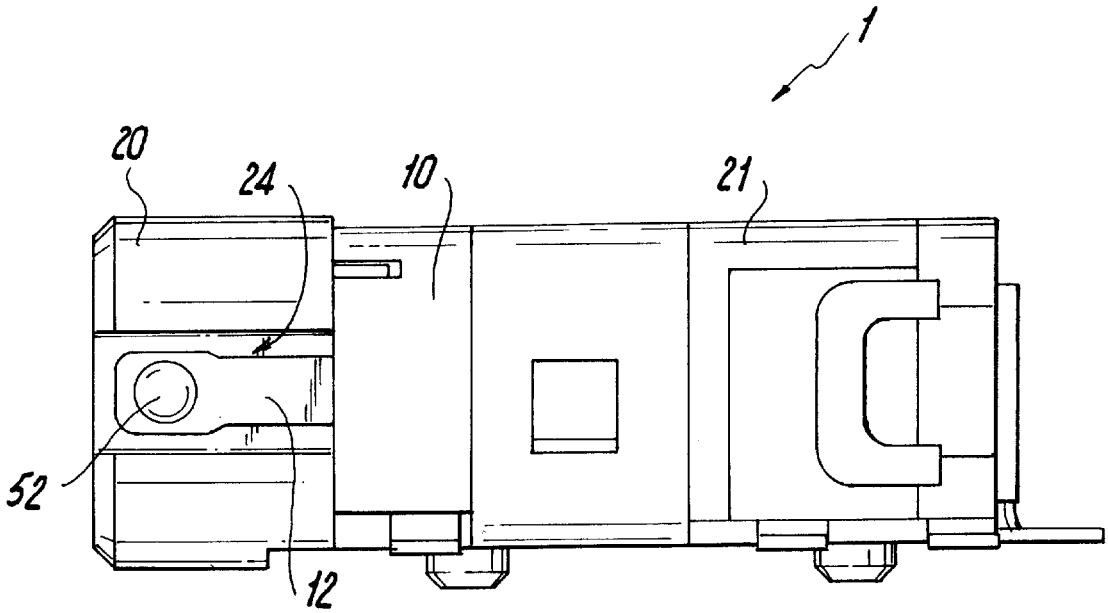
FIG. 2 is a side view of the jack of FIG. 1.

Referring now to FIGS. 1 and 2, a jack 1 includes a housing 10 made from an insulating material such as synthetic resin. Housing 10 also includes a first external connection terminal 11 and a second external connection terminal 12. First external connection terminal 11 and second external connection terminal 12 are formed by die cutting and bending a metal sheet. Jack 1 also includes a plurality of internal connection terminals (not shown).

Housing 10 includes a cylindrical piece 20 and a body 21. Body 21 is approximately rectangular with a hollow interior space or chamber(not shown). A plug insertion hole 22 is formed on cylindrical piece 20. Plug insertion hole 22 connects with the hollow interior space inside body 21. During operation, when a plug (not shown) is inserted into plug insertion hole 22, the plug penetrates into the hollow interior space.

Figure 3:
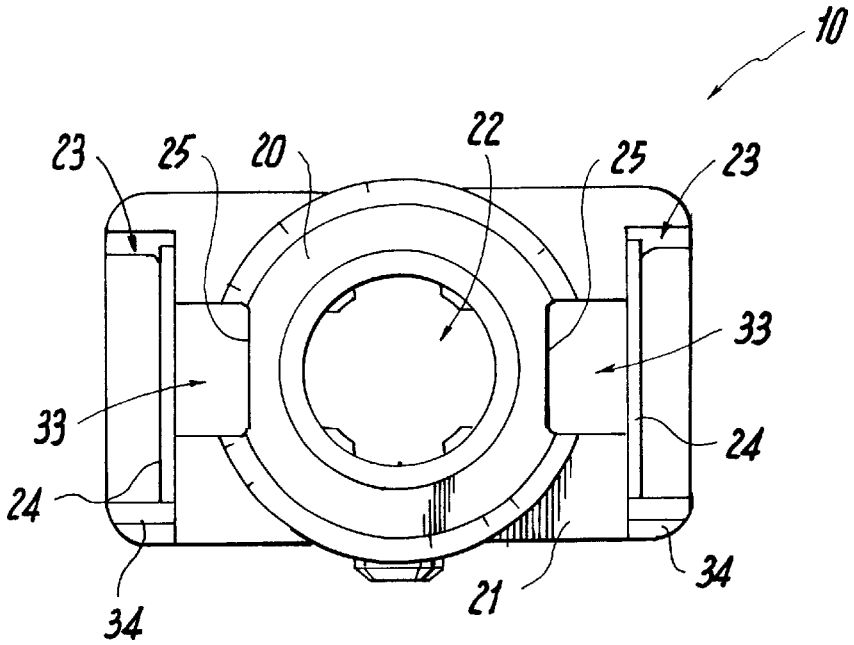
FIG. 3 is a front view of a housing according to an embodiment of the present invention.

Referring now also to FIG. 3, a horizontal groove 23 (described later) is located on a the left and right front sides of body 21. Horizontal groove 23 is approximately parallel to a bottom surface of body 21. A pair of vertical grooves 24 are disposed perpendicular to the bottom surface of body 21. Each vertical groove 24 contacts a wall 25. A contact piece 52 is positioned opposite each wall 25, as will be explained. Horizontal groove 23 and vertical groove 24 are formed in a continuous manner. Vertical groove 24 is deeper than horizontal groove 23.

Figure 4:
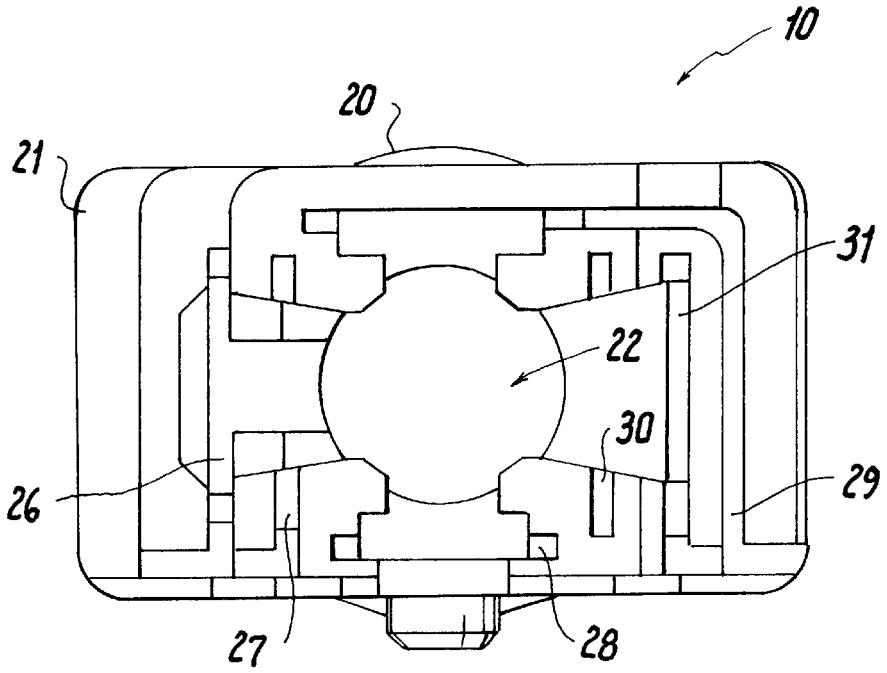
FIG. 4 is a rear view of the housing of FIG. 3.
Figure 5:
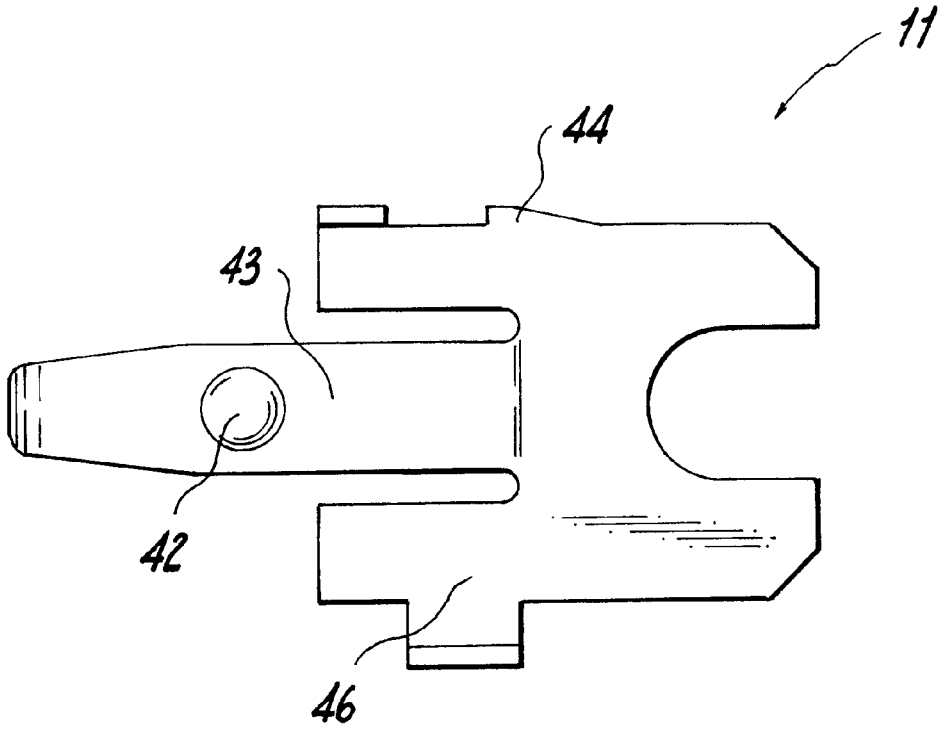
FIG. 5 is a side view of a first external connection terminal.

Referring now also to FIG. 4, a lower corner of vertical groove 24 is cut to make a cut 34. Notches 33 are formed on cylindrical piece 20 opposite each respective wall 25. Notches 33 are generally symmetrical with respect to plug insertion hole 22. Notches 33 are formed up to a tip (not shown) of cylindrical piece 20 in a direction parallel to the plug insertion direction.

A first tip spring insertion hole 26 and a second tip spring insertion hole 27 are formed in body 21. A first sleeve spring insertion hole 28 and a second sleeve spring insertion hole 29 are also formed in body 21. A first terminal insertion hole 30 and a ring spring insertion hole 31 are opened on a back side of body 21, in a direction parallel to the plug insertion direction.

Figure 15:
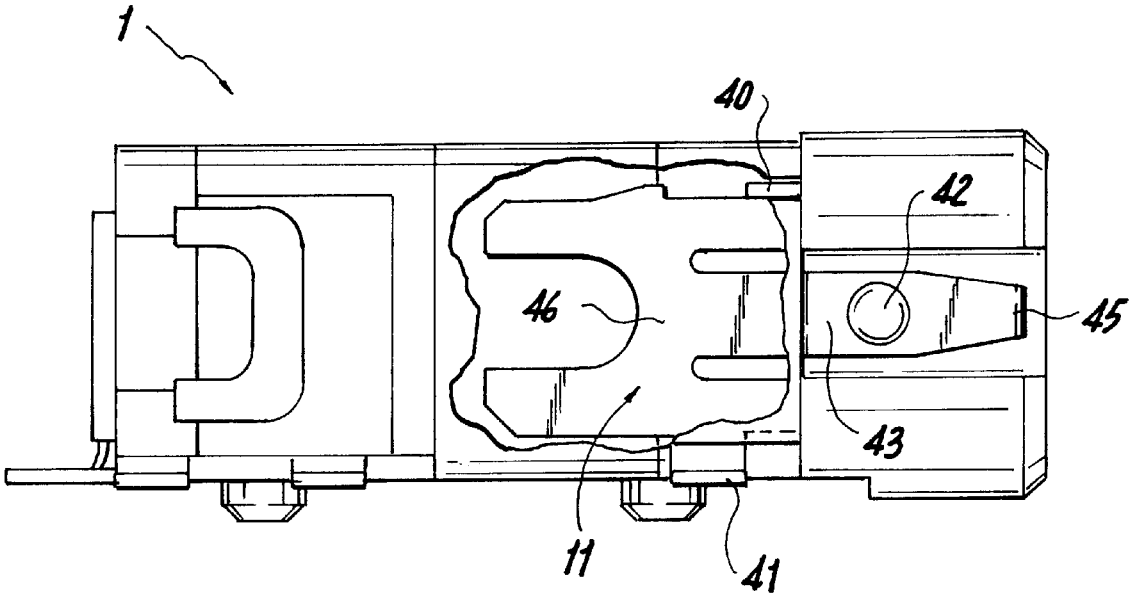
FIG. 15 is a side and cutaway view of the jack of FIG. 1.

Referring now also to FIGS. 5 to 7, and 15 first external terminal 11 includes elastic piece 43, a latching tab 44, and a contact piece 42. FIG. 15 is a side and cutaway view of first external terminal 11 as it is positioned inside the housing 10 of FIGS. 1 and 2. First external terminal 11 is roughly C-shaped in cross-section. Contact piece 42 is generally spherically protruding outward (downward in FIG. 6) on a surface of elastic piece 43. An end portion 45, of elastic piece 43, is bent inward opposite contact piece 42, as will be explained. Contact piece 42 generally extends in the direction of support piece 40 and leg piece 41.

First external terminal 11 further includes a support piece 40 and a leg piece 41. Support piece 40 is formed by bending an upper part of first external terminal 11 approximately 90 degrees to a front face surface. Leg piece 41 is also formed by bending a lower part of first external terminal 11 approximately 90 degrees in the same direction. Leg piece 41 is positioned for soldering to a conductive piece (not shown) of a substrate (not shown).

Elastic piece 43 operates as a sheet spring. Elastic piece 43 is bent slightly inward (center upward in FIG. 6) from approximately a center of support piece 40 and leg piece 41, to extend forward in a direction parallel to the plug insertion direction (left-right of FIG. 5).

A holding piece 46 is formed on a side of first external connection terminal 11. Latching tab 44 is formed on a side of holding piece 46. During assembly, first external connection terminal 11 is fastened on housing 10 by pressing latching tab 44 into housing 10, as will be explained.

Figure 8:
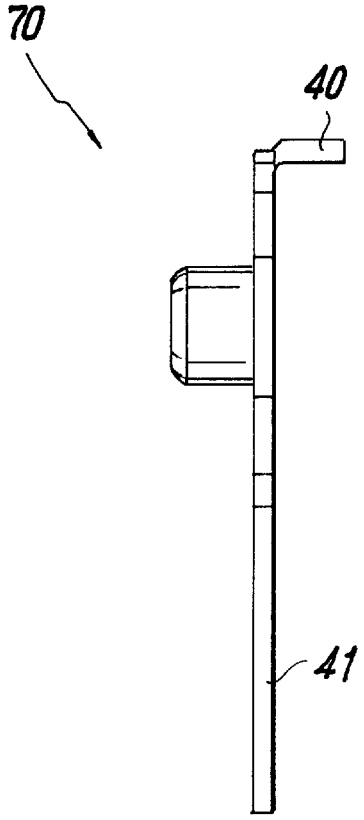
FIG. 8 is a second embodiment of first external connection terminal.
Figure 9:
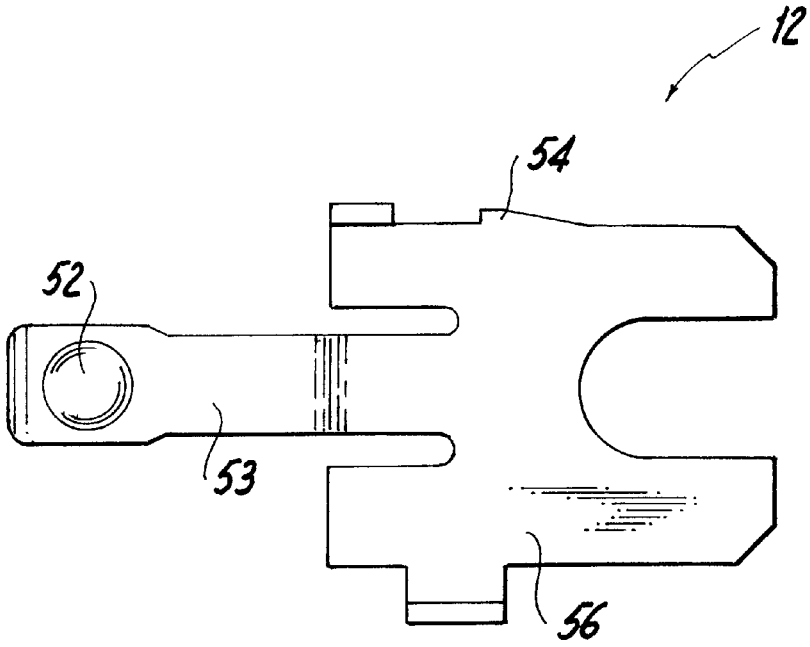
FIG. 9 is a side view of a second external connection terminal.

Referring FIG. 8, a second embodiment 70, of an external connection terminal 11 includes leg piece 41 that, instead of being bent, and extends directly downward, away from leg piece 41, parallel to the face of latching tab 44.

The external connection terminal 11 is used as a terminal for mounting onto a surface. Thus, leg piece 41 must be bent to accommodate the surface. Second embodiment 70 of external connection terminal 11 is used as a terminal which passes through holes formed on a substrate (not shown) for connection at a back side of the substrate by soldering or other means. Since leg piece 41 of second embodiment 70 must extend through the substrate, it is shaped to accomplish this task.

Figure 14:
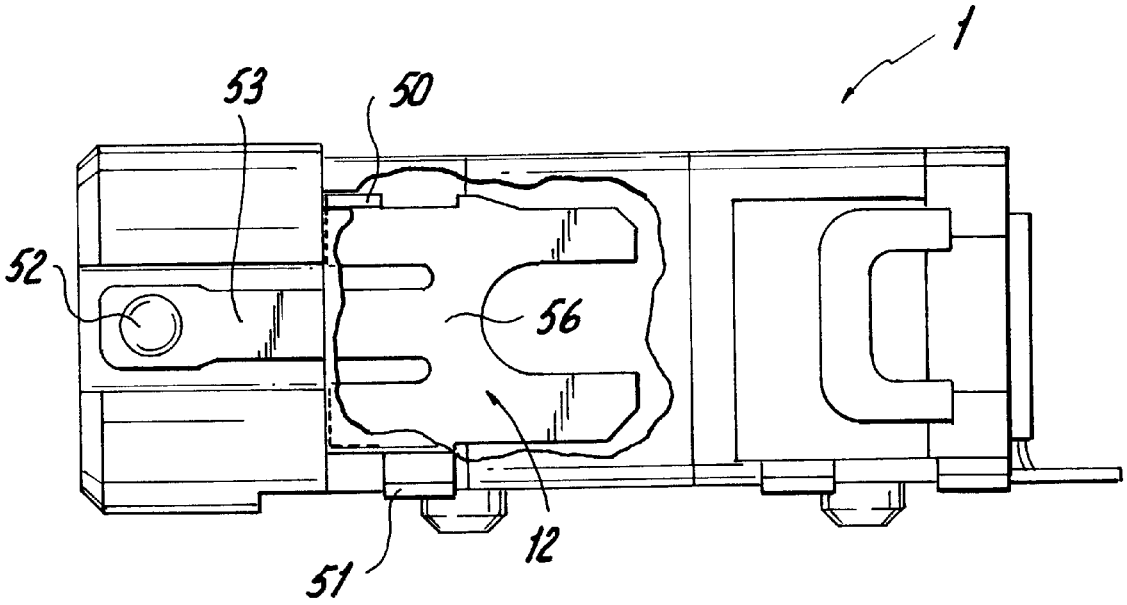
FIG. 14 is a side and cutaway view of the jack of FIG. 1.

Referring now to FIGS. 9 through 11, and 14, second external terminal 12 has a rough and approximate U-shaped cross-section. FIG. 14 is a side and cutaway view of second external terminal 12 as it is positioned inside the housing 10 of FIGS. 1 and 2. A support piece 50 extends from second external terminal 12 at an approximate 90 degree angle to a surface of second external terminal 12.

A leg piece 51, is also formed at an approximately 90 degree angle to the surface of second external terminal 12. Leg piece 51 and support piece 50 extend in a similar direction relative to second external terminal 12.

An elastic piece 53 extends from second external terminal 12 between support piece 50 and leg piece 51. Elastic piece 53 is a flat spring and is bent slightly inward (downward in FIG. 10), to enable elastic connection as will be explained. Elastic piece 53 extends in a longitudinal direction relative to second external contact terminal 12 (in the left-right direction of FIG. 9)

Figure 10:
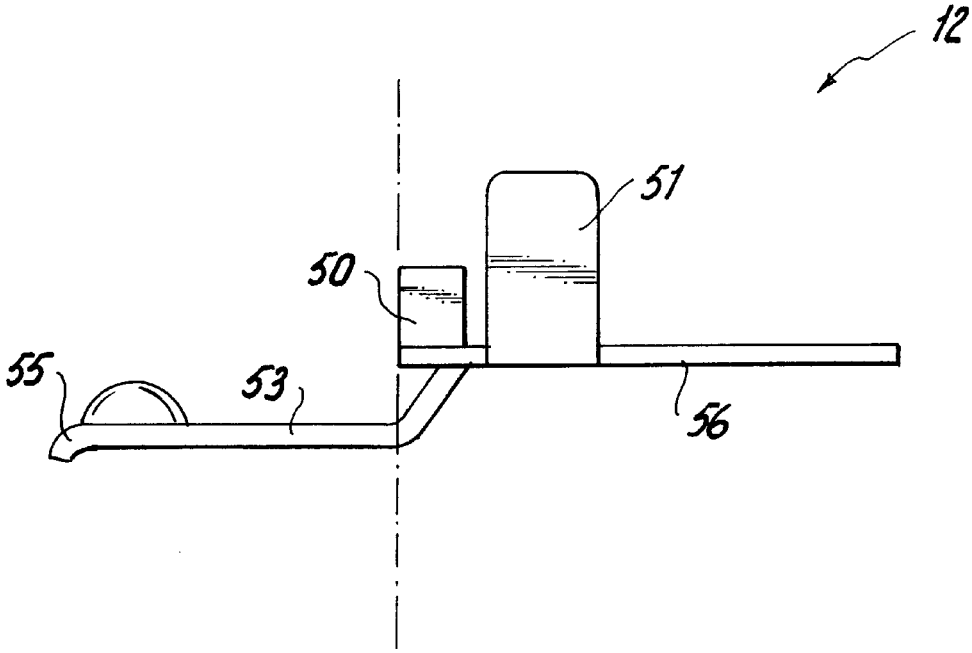
FIG. 10 is a bottom view of a second external connection terminal.
Figure 11:
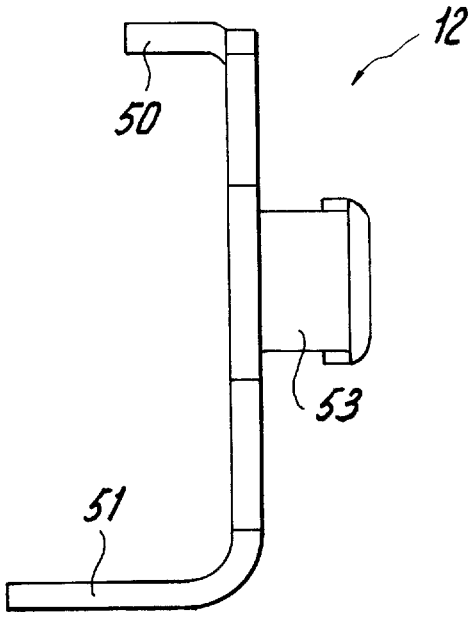
FIG. 11 is a rear view of a second external connection terminal.

Contact piece 52 spherically protrudes outward on elastic piece 53 (upward in FIG. 10). Contact piece 52 extends generally in the same direction as leg piece 51 and support piece 50 on elastic piece 53. An end portion 55, of elastic piece 53, is bent inward (downward in FIG. 10) away from leg piece 51. A latching tab 54 is formed on a side surface of second external connection terminal 12. During assembly, second external connection terminal 12 is pressed into housing 10 and latched by latching tab 54.

A holding piece 56 is formed on a side of second external connection terminal 12. Latching tab 45 is formed on a side surface of holding piece 56. During assembly, second external connection terminal 12 is fastened onto housing 10 by pressing latching tab 54 into housing 10, as will be explained.

Figure 12:
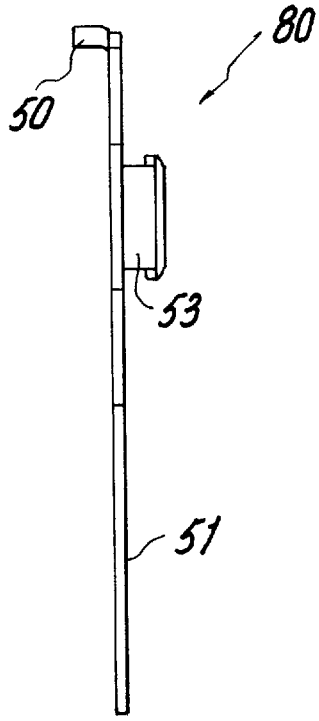
FIG. 12 is a second embodiment of a second external connection terminal.

Referring now to FIG. 12, a second embodiment 80 of second external connection terminal 12 includes a leg piece 51 that is not bent, but extends parallel to the face surface of second external connection terminal 12 (downwards in FIG. 12). In the first embodiment of second external connection terminal 12, leg piece 51 is used as a terminal for mounting onto a surface. In second embodiment 80, leg piece 51 is used as a terminal which passes through holes in the substrate (not shown) for connection to the back side of the substrate.

Figure 13:
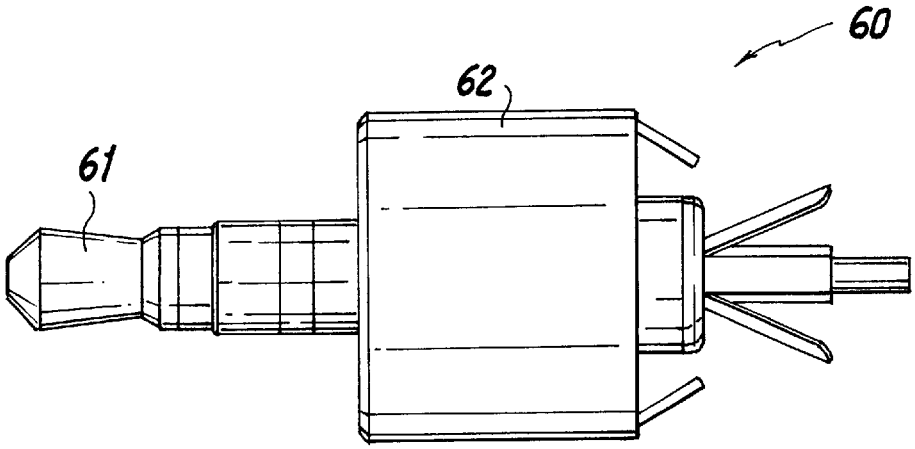
FIG. 13 is a side view of a plug for use on the jack.

Referring now to FIG. 13, an example of a plug 60 that is connectable with jack 1 includes a single-head plug piece 61 and a cylindrical piece 62. Cylindrical piece 62 is about a perimeter of and coaxial with single-head plug piece 61. Single head plug piece 61 protrudes away from an end of cylindrical piece 62 in a longitudinal direction (left-side of FIG. 13).

A plurality of conductive members are located on single-head plug piece 61. The conductive members are positioned in a mutually insulated manner along the longitudinal direction. Terminals (not further described) on plug 60, connect to first external connection terminal 11 and second external connection terminal 12. The terminals are each held in place on an inner perimeter wall of cylindrical piece 62.

During assembly in jack 1, support piece 40, of first external connection terminal 11 and support piece 50, of second external connection terminal 12, join respective horizontal grooves 23 on housing 10. Similarly, respective holding piece 46 and holding piece 56 fit into respective vertical groove 24. Latching tab 44 and latching tab 54 are urged against an inner wall of housing 10. Latching tabs 44, 54 engage the inner wall of housing 10 to retain first external connection terminal 11 and second external connection terminal 12 within housing 10.

After insertion, respective leg pieces 41, 51 are bent outward from housing 10 at approximately 90 degrees to protrude from cut piece 34. Leg pieces 41, 51 are bent to enable attachment to a substrate (not shown) and may be bent accordingly.

Support piece 40 and support piece 50 may also be pushed into the inner wall of housing 10 to further secure respective first and second external connection terminals 11, 12.

During assembly, first and second external connection terminals 11, 12 are inserted from a back side of housing 10 into respective tip spring insertion hole 26, second terminal insertion hole 27, first sleeve spring insertion hole 28, second sleeve spring insertion hole 29, first terminal insertion hole 30, and ring spring insertion hole 31, while an inner connection terminal (not shown) is held in place on housing 10.

The sequence for installing the inner connection terminal (not shown) and the external connection terminals 11, 12 may be reversed for disassembly.

Figure 6:
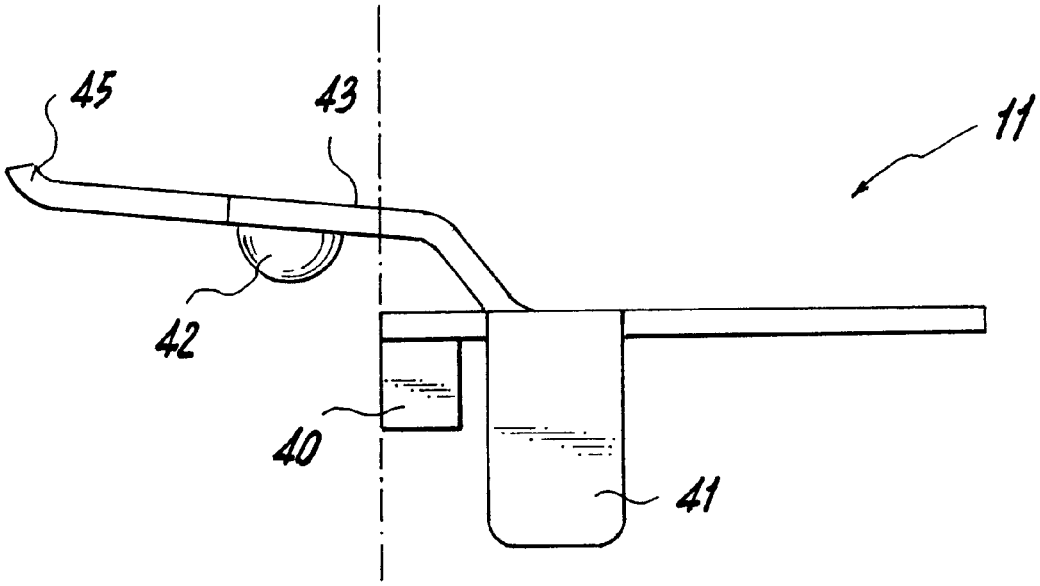
FIG. 6 is a bottom view of a first external connection terminal.
Figure 7:
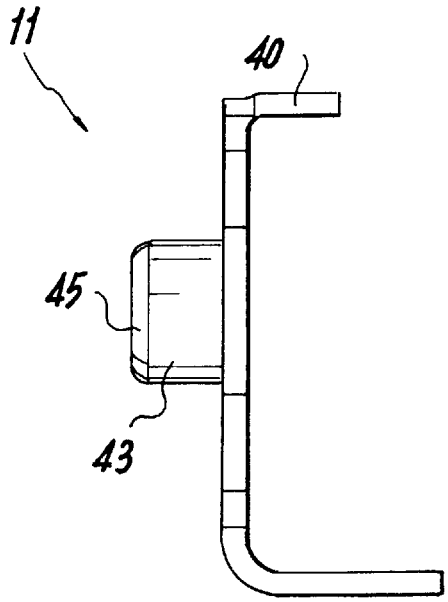
FIG. 7 is a rear view of a first external connection terminal.

Upon complete assembly, everything to the left-side (from the readers perspective) of the dashed line in FIGS. 6 and 10, protrudes away from body 21. The right side of the dashed line in FIGS. 6 and 10 (from the readers perspective), includes holding pieces 46, 56, is located inside body 21 in respective vertical grooves 24.

After assembly, contact pieces 42, 52 protrude outward into the insertion pathway of plug 60. During assembly, contact piece 52 is positioned to a front of contact piece 42, relative to body 21. Each is in a shifted position (front and back) with respect to the plug insertion direction.

After assembly, contact pieces 42, 52 are positioned on the periphery of cylindrical piece 62. As long as contact pieces 42, 52 are on and along the plug insertion pathway, contact pieces 42, 52 may be positioned near the outer periphery of cylindrical piece 62 to provide contact with plug 60. Contact pieces 42, 52 are in symmetric positions with respect to a center of plug insertion hole 22. Contact pieces 42, 52 are protuberances that protrude outward away from plug insertion hole 22.

During operation, plug 60 is inserted into jack 1 in plug insertion hole 22. During insertion, single-head plug piece 61 first contacts the inner connection terminal, and next contacts external connection terminals 11, 12. During contact with external connection terminals 11, 12, elastic pieces 43, 53 are pushed inward by an inner wall of cylindrical piece 62 on plug 60 and are elastically deformed towards plug insertion hole 22.

During elastic deformation of elastic pieces 43, 53, end portions 45, 55 contact respective walls 25 of notches 33 on cylindrical piece 20, and by being further pushed by the inner wall of plug 60, end pieces 45, 55 are elastically deformed towards plug insertion hole 22.

When the conductive piece of plug 60 and contact pieces 42, 52 are connected, external connection terminals 11, 12 are electrically connected to the conductive piece of plug 60 and supported at two points by latching tabs 44, 54 and end pieces 45, 55. The sequence of contact of external connection terminals 11, 12 is:

1) first; second external connection terminal 12 contacts plug 60,
2) next first external connection terminal 11 contacts plug 60.

This timing can be changed by shifting the respective front-back position of contact pieces 42, 52. In contrast, the inner connection terminal is pressed by plug 60 and is elastically deformed and retreats from the plug insertion pathway. By elastic force, the terminal of jack 1 and the specified conductive piece of plug 60 are electrically connected.

When plug 60 is removed from plug insertion hole 22, the inner connection terminal and external connection terminals 11, 12 return to their initial conditions by their own elasticity, and end pieces 45, 55 separate from walls 25.

Frequently, jack 1 is built into mobile phones or other mobile electronic devices, with the inner connection terminal used as an audio signal terminal for the device. External connection terminals 11, 12 are used as control signal terminals.

As one benefit of the present invention, for example, external connection terminal 11 may be used for detecting whether a plug is connected in stereo or monaural mode. By detecting with external connection terminal 11, a circuit on a device side may be easily switched to either stereo or monaural. As a second example, external connection terminal 12 may be used as a control signal terminal for remote control. In other words, when using a mobile phone as a 'hands free' phone, and when there is signal reception, it is possible to switch the device to a talking mode on the remote control side. This switching may be conducted by external connection terminal 12.

As a further benefit, in addition to the internal connection terminal, jack 1 also includes first external connection terminal 11 and second external connection terminal 12. As a result, the number of separate poles available for contact is increased, and jack 1 may easily support devices that are multi-functional.

First external connection terminal 11 and second external connection terminal 12 are positioned at symmetric positions with respect to plug insertion hole 22. As a result, during plug 60 insertion, contact pressure is applied equally to the respective plug terminals, and the connection is physically stabilized.

First external connection terminal 11 and second external connection terminal 12 include support pieces 40, 50. Because support piece 40 and support piece 50 join with or are pressed into groove 23, the positioning of corresponding leg pieces 41, 51 is conducted accurately, easily, and securely. In sum, first and second external connection terminals 11, 12 are easily secured in body 21 of housing 10. Due to this easy accuracy and stability, jack 1 may be soldered onto the substrate (not shown), without any instability and processing errors are reduced.

Elastic piece 43 and elastic piece 53 of first external connection terminal 11 and second external connection terminal 12 operate as flat-type springs. During plug insertion, electrical and physical contact is made by elastic deformation. As a result, precise measurement and positioning is not needed, whereby manufacturing is further simplified while maintaining quality and reliability.

As a further benefit of the present invention, first external connection terminal 11 and second external connection terminal 12 are held in place by pushing latching tab 44 and latching tab 54 into housing 10. As a result, assembly is easy and secure.

In addition, the positions of contact piece 42 and contact piece 52 can be shifted forward and backward within the position of elastic piece 43 and elastic piece 53 in a direction parallel to the plug insertion direction. By doing so, the timing and relative force of contact with the plug terminals at the time of plug insertion is easily varied. As a result, the same housing 10 can be used for various specifications just by exchanging respective first external connection terminal 11 and second external connection terminal 12, and costs are reduced.

First external connection terminal 11 and second external connection terminal 12 are positioned at or near the perimeter of cylindrical piece 20. As a result, cylindrical piece 20 can be inserted into plugs without cylindrical pieces such as the standard three pole plug, and it is thus non-specific, thereby allowing beneficial adaptation.

As a further benefit of the present design, contact pieces 42, 52 protrude outward away from plug insertion hole 22 and the space for the bending of elastic pieces 43, 53 is increased which allows the entire jack 1 to be made smaller. If contact pieces 42, 52 were to protrude inward, the available space would be inappropriately small and jack 1 would need to increase in size to accommodate the change.

During connection to plug 60, the conductive piece of plug 60 connect to first and second external connection terminals 11, 12, which are each supported at two points by respective latching tabs 44, 54 and end pieces 45, 55. This support enables adequate contact pressure and stable electrical connection.

The present invention is not limited to the above preferred embodiments and that other variations are within the scope of the present invention. For example, additional external connection terminals may be arranged on jack 1. To accommodate additional external connection terminals, their width and length may be modified relative to each other and to jack 1 to enable secure and easy connection to jack 1 and connection to a plug.

Although contact pieces 42, 52 of respective first and second external connection terminals 11, 12 are described as placed in symmetric positions with respect to plug insertion hole 22, they may instead be placed asymmetrically to accommodate alternative individual plug designs.

In the preferred embodiment of the present invention, jack 1 is six-poled, but can any number of plurality of poles is possible with the design. For example, a four-pole or an eight-pole jack is considered to fall within the spirit and scope of the invention.

While the present invention, jack 1 is adapted for assembly into a mobile phone, it can be built into various other electronic communication devices, portable or fixed. Since jack 1 of the present invention is provided with external connection terminals as well as internal connection terminals, it may be employed multi-functionally.

After assembly, the present invention can be installed onto a soldering surface (not shown) of a substrate (not shown) without instability at the time of soldering.

Although only a few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the spirit and scope of this invention as defined in the following claims. In the claims, means-plus-function clauses are intended to cover the structures described or suggested herein as performing the recited function and not only structural equivalents but also equivalent structures. Thus, for example, although a nail, a screw, and a bolt may not be structural equivalents in that a nail relies entirely on friction between a wooden part and a cylindrical surface, a screw's helical surface positively engages the wooden part, and a bolt's head and nut compress opposite sides of the wooden part together, in the environment of fastening wooden parts, a nail, a screw, and a bolt may be readily understood by those skilled in the art as equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A jack, for electrically connecting a plug to a circuit, comprising:

a housing;

said housing including a body piece and an insertion piece;

said insertion piece having a first perimeter and an insertion hole;

said body piece bounding a chamber adjacent said insertion hole;

said insertion hole and said chamber being effective to receive said plug along a plug insertion direction;

at least a first external connection terminal in said housing;

said first external connection terminal including at least a first contact piece, a first elastic piece, a first leg piece, and a first latching tab;

said first elastic piece operable parallel to said plug insertion direction;

said first leg piece extending perpendicular to said plug insertion direction;

said first latching tab fixing said first external connection terminal in at least a first long groove in said housing;

said first contact piece extending away from said insertion hole and being proximate said first perimeter; and said first elastic piece and said first contact piece including means for providing an elastic engagement for said plug at a first inner portion of said plug and for displacing said first contact piece toward said insertion hole, whereby said jack enables reliable and elastic electrical connection from said plug to said circuit:

at least a second external connection terminal in said housing;

said second external connection terminal includes at least a second contact piece extending away from said insertion hole proximate to said first perimeter;

a second elastic piece and said second contact piece effective to elastically engage a second inner portion of said plug and said second contact piece being displaced toward said insertion hole when said plug is inserted, whereby said jack enables reliable and elastic multi-pole electrical connection from said plug to said circuit.

2. A jack, according to claim 1, further comprising:

at least a second long groove in said housing;

said first long groove being parallel to said plug insertion direction; and said second long groove being parallel to said plug insertion direction.

3. A jack, according to claim 2, further comprising:

a first holding piece on said first external connection terminal;

a first support piece on said first external connection terminal;

said first support piece including a first bent piece projecting perpendicular from said first support piece; and said first long groove effective to guidably receive said first holding piece, said first support piece, and said first latching tab and retain said first external connection terminal in said first long groove, thereby supporting said first elastic piece and said first contact piece.

4. A jack, according to claim 3, wherein:

said second external connection terminal comprises a second leg piece, and a second latching tab;

said second leg piece extending perpendicular to said plug insertion direction.

5. A jack, according to claim 4, further comprising:

a second holding piece on said second external connection terminal;

a second support piece on said second external connection terminal; and said second long groove effective to guidably receive at least said second holding piece, said second support piece, and said second latching tab and retain said second external connection terminal in said second long groove, thereby supporting said second elastic piece and said second contact piece.

6. A jack, for electrically connecting a plug to a circuit, comprising:

a housing;

said housing including a body piece and an insertion piece;

said insertion piece having a first perimeter and an insertion hole;

said body piece bounding a chamber adjacent said insertion hole;

said insertion hole and said chamber being effective to receive said plug along a plug insertion direction;

at least a first external connection terminal in said housing;

said first external connection terminal including at least a first contact piece, a first elastic piece, a first leg piece, and a first latching tab;

said first elastic piece operable parallel to said plug insertion direction;

said first leg piece extending perpendicular to said plug insertion direction;

said first latching tab fixing said first external connection terminal in at least a first long groove in said housing;

said first contact piece extending away from said insertion hole and being proximate said first perimeter;

said first elastic piece and said first contact piece including means for providing an elastic engagement for said plug at a first inner portion of said plug and for displacing said first contact piece toward said insertion hole, whereby said jack enables reliable and elastic electrical connection from said plug to said circuit;

at least a second long groove in said housing;

said first long groove being parallel to said plug insertion direction; and said second long groove being parallel to said plug insertion direction;

a first short groove;

said first short groove continuous with at least said first long groove;

a second short groove;

said second short groove continuous with at least said second long groove;

said first short groove effective to receive said first elastic piece and enable said first elastic piece and said first contact piece to elastically displace toward said insertion hole when said plug is inserted, whereby said first elastic piece has sufficient room to elastically flex in said first short groove while minimizing a size of said jack; and said second short groove effective to receive said second elastic piece and enable said second elastic piece and said second contact piece to elastically displace toward said insertion hole when said plug is inserted, whereby said second elastic piece has sufficient room to elastically flex in said second short groove while minimizing said size of said jack.

7. A jack, according to claim 6, wherein:

said first and said second leg pieces extend parallel to a substrate face of said jack, thereby enabling secure soldering of said jack to an external substrate and said circuit.

8. A jack, according to claim 6, wherein:

said first and said second leg pieces extend perpendicular to a substrate face of said jack, thereby enabling securing soldering of said jack to an external substrate and said circuit.

9. A jack, according to claim 6, wherein:

said body piece including a plurality of inner connection terminal holes;

said plurality of inner connection terminal holes begin digitally accessible on a side of said body piece opposite said insertion piece; and said plurality of inner connection terminal holes effective to securely receive at least one corresponding inner connection terminal during an assembly of said jack, whereby said jack is easily and rapidly assembled and production time is reduced.

10. A jack, according to claim 6, further comprising:

a first end portion on said first elastic piece opposite said first leg piece;

a second end portion in said second elastic piece opposite said second leg piece;

a first wall in said first short groove opposite said first end portion;

a second wall in said second short groove opposite said second end portion;

said first end portion positioned to contact said first wall when a plug is inserted;

said second end portion positioned to contact said second wall when a plug is inserted; and said first and said second walls effective to restrain an elastic deflection of said first and said second end portions in a deflection direction during said insertion, thereby enabling a secure and stable electrical connection with an increased elastic resistance.

11. A jack, according to claim 10, further comprising:

a first distance between said first contact piece and said first end portion;

a second distance between said second contact piece and said second end portion;

said first inner portion being opposite said first contact piece;

said second inner portion being opposite said second contact piece;

said first distance is not equivalent to said second distance, and said first contact piece and said second contact piece being effective to provide elastic electrical connection to corresponding said first and said second inner portions of said plug, whereby said jack is easily adapted to differing plug designs while providing secure electrical connection.

12. A jack, for electrically connecting a plug to a circuit, comprising:

a housing;

said housing including a body piece and an insertion piece;

said insertion piece having a first perimeter and an insertion hole;

said body piece bounding a chamber adjacent said insertion hole;

said insertion hole and said chamber effective to receive said plug along a plug insertion direction;

first external connection means for providing an elastic engagement for a first inner portion of said plug when the plug is inserted and providing an electrical connection for the circuit;

said first external connection means including at least a first contact piece and a first elastic piece;

means for fixing said first external connection means to said housing;

said first elastic piece positioned to provide an elastic engagement for said first inner portion of said plug when the plug is inserted;

said first contact piece extending away from said insertion hole and being proximate said first perimeter, whereby said first external connection means and said means for fixing provide secure elastic electrical connection from said plug to said circuit at least a second external connection terminal in said housing;

said second external connection terminal includes at least a second contact piece extending away from said insertion hole proximate to said first perimeter;

a second elastic piece and said second contact piece effective to elastically engage a second inner portion of said plug and said second contact piece being displaced toward said insertion hole when said plug is inserted, whereby said jack enables reliable and elastic multi-pole electrical connection from said plug to said circuit.

13. A jack, for electrically connecting a plug to a circuit, comprising:

an insulating housing;

said insulating housing including a cylindrical piece and a body piece;

said cylindrical piece including a plug insertion hole;

said body piece including a hollow adjacent said plug insertion hole;

said hollow and said plug insertion hole effective to receive said plug from a plug insertion direction;

at least a first internal terminal for providing a connection to a first conductive piece of said plug when the plug is inserted;

at least a first external connection terminal;

said first external connection terminal having at least a first contact piece; and said first contact piece proximate an outer perimeter of said cylindrical piece effective to provide an elastic and secure connection for a second conductive piece of said plug to said circuit when the plug is inserted at least a second external connection terminal in said housing;

said second external connection terminal includes at least a second contact piece extending away from said insertion hole proximate to said first perimeter;

a second elastic piece and said second contact piece effective to elastically engage a second inner portion of said plug and said second contact piece being displaced toward said insertion hole when said plug is inserted, whereby said jack enables reliable and elastic multi-pole electrical connection from said plug to said circuit.

14. A jack, according to claim 13, wherein:

said first external connection terminal includes a first holding piece;

said first holding piece being effective to retain said first external connection terminal in said housing;

said first external connection terminal includes a first elastic piece;

said first contact piece on said first elastic piece; and said first elastic piece extends in a direction parallel to a plug insertion direction and is effective to elastically deform when said plug is inserted to provide an elastic and secure electrical connection for said first contact piece to provide said connection point for a first inner conducting piece of said plug.

15. A jack, according to claim 14, wherein:

said first external connection terminal includes a first end piece;

said end piece on said first elastic piece opposite said first holding piece;

said first end piece in a position opposite said cylindrical piece;

said first end piece bent in a direction toward said plug insertion hole; and said first end piece effective to contact a surface of said cylindrical piece when said plug is inserted, whereby said jack provides secure electrical connection from said plug to said circuit.

16. A jack, according to claim 15, wherein:

said first contact piece between said first end piece and said first holding piece on said first elastic piece, whereby a position of said first contact piece is easily adaptable by an external manufacturer to correspond match said plug.

17. A jack, according to claim 15, wherein:

said first contact piece protruding from said first elastic piece in a first direction away from said insertion hole, whereby said first contact piece can easily electrically connect to an inner conductive surface of said plug.

18. A jack, according to claim 16, wherein:

said first holding piece includes a first support piece;

said first support piece extending perpendicular from said first holding piece;

a first long groove in said body piece;

said first long groove parallel a lower surface of said body piece; and said first support piece retained in said first long groove, whereby elastic electrical connection with said plug is simplified.

19. A jack, according to claim 18, further comprising:

a first short groove in said body piece;

said first short groove continuous with said first long grove;

said first short groove effective to receive said first elastic piece when said plug is inserted thereby enabling secure electrical connection from said plug to said circuit.

20. A jack, according to claim 19, further comprising:

a first leg piece on said first external connection terminal; and said first leg piece extending away from said external connection terminal perpendicular said insertion direction.

21. A jack, according to claim 20, wherein:

said first external connection terminal is effective as a first terminal for conducting an external control signal from said plug to said circuit.

22. A jack, according to claim 20, wherein:

said jack and said first external connection terminal is effective to control an external remote control.

23. A jack, for electrically connecting a plug to a circuit, comprising:

a housing including a body piece and an insertion piece;

said insertion piece having a first perimeter and an insertion hole;

at least a first external connection terminal in said housing;

a first contact piece and a first elastic piece in said first external connection terminal;

said first contact piece extending away from said insertion hole and being proximate said first perimeter; and said first elastic piece and said first contact piece including means for providing an elastic engagement for a first inner portion of said plug when said plug is inserted and for displacing said first contact piece toward said insertion hole, whereby said jack enables reliable and electrical connection from said plug to said circuit at least a second external connection terminal in said housing;

said second external connection terminal includes at least a second contact piece extending away from said insertion hole proximate to said first perimeter;

a second elastic piece and said second contact piece effective to elastically engage a second inner portion of said plug and said second contact piece being displaced toward said insertion hole when said plug is inserted, whereby said jack enables reliable and elastic multipole electrical connection from said plug to said circuit.

* * * * *